US005769570A

United States Patent [19]

Stankus et al.

[11] Patent Number: 5,769,570

[45] Date of Patent: Jun. 23, 1998

[54] CABLE TENSIONING DOME PLATE

[75] Inventors: John C. Stankus, Canonsburg; Eugene H. Stewart, Pittsburgh, both of Pa.; Kendal L. Taylor, Arthurdale, W. Va.

[73] Assignee: Jennmar Corporation, Pittsburgh, Pa.

[21] Appl. No.: 659,076

[22] Filed: Jun. 3, 1996

[51] Int. Cl.[6] ..... E21D 21/00

[52] U.S. Cl. ..... 405/302.1; 411/156

[58] Field of Search ..... 405/302.1; 411/155, 411/156, 531

[56] References Cited

U.S. PATENT DOCUMENTS

| | | | |
|---|---|---|---|
| D. 301,687 | 6/1989 | Cassidy et al. | D8/399 |
| 2,748,594 | 6/1956 | Edwards | 411/76 |
| 2,850,937 | 9/1958 | Ralston | 411/11 |
| 3,133,468 | 5/1964 | Cumming | 411/11 |
| 3,224,202 | 12/1965 | Durget | 405/302.1 |
| 3,238,731 | 3/1966 | Seifert et al. | 405/302.1 |
| 3,329,058 | 7/1967 | Cumming | 411/11 |
| 3,478,523 | 11/1969 | Reusser et al. | 405/302.1 |
| 3,702,060 | 11/1972 | Cumming | 405/259.6 |
| 4,112,693 | 9/1978 | Collin et al. | 405/302.1 |
| 4,445,808 | 5/1984 | Arya | 405/302.1 |
| 4,648,753 | 3/1987 | Stephan | 405/259.5 |
| 4,652,178 | 3/1987 | Kates et al. | 405/302.1 |
| 4,708,559 | 11/1987 | Locotos | 411/545 |
| 5,192,146 | 3/1993 | Landsberg | 405/259.1 |
| 5,230,589 | 7/1993 | Gillespie | 405/259.6 |
| 5,282,710 | 2/1994 | Triesethau | 411/531 X |
| 5,628,710 | 5/1997 | Lesslie | 411/531 X |

FOREIGN PATENT DOCUMENTS

| | | |
|---|---|---|
| 254241 | 5/1963 | Australia . |
| 6804381 | 9/1981 | Australia . |

OTHER PUBLICATIONS

Parker, Sybil P., McGraw–Hill Dictionary of Scientific and Technical Terms, 4th Edition, p. 502, 1989.

*Primary Examiner*—Tamara L. Graysay
*Assistant Examiner*—Tara L. Mayo
*Attorney, Agent, or Firm*—Webb Ziesenheim Bruening Logsdon Orkin & Hanson, P.C.

[57] ABSTRACT

A mine roof bearing plate having a planar member having a topside, an underside and an elastically deformable domed portion extended downwardly from the underside. A central section at the outer extremity of the domed section defines a bolt hole. The outer extremity of the domed portion includes a downwardly facing beveled annular bearing surface which mates with a spherical washer. A method of tensioning a cable bolt including the steps of placing a spherical washer over a first end of a cable bolt having a bolt head on the other end, placing the inventive mine roof bearing plate over the end of the cable bolt, inserting the cable bolt into a mine roof bolt hole, exerting pressure on the bolt head whereby the bolt head presses on the spherical washer and elastically deforms the domed portion, installing the cable bolt in the bolt hole and releasing pressure from the other end of the cable bolt whereby the domed portion substantially reforms to its original configuration to exert tension of the cable bolt.

12 Claims, 2 Drawing Sheets

CABLE TENSIONING DOME PLATE

BACKGROUND OF THE INVENTION

1. Field of the Invention

The present invention relates to cable tensioning dome plates, more particularly to a cable bolt tensioning plate which elastically deforms and reforms to exert tension in an installed cable bolt.

2. Prior Art

Conventional mine roof bearing plates typically include a steel plate designed for use in mines and the like to bind together rock strata to stabilize the rock formation and prevent its collapse. The plate is used in conjunction with a mine roof bolt passing through the bearing plate together with a conventional rock anchoring system. Bearing plates are used both with rock bolts and cable bolts.

Cable bolts are typically used in mining when lateral stresses on the bolts are expected. Cable bolts provide some flexibility and allow the bolt to move laterally within the rock strata. Depending on the roof conditions and the application, roof bolts including cable bolts may be designed to be tensioned during their installation to compress the rock strata.

During installation of such a cable bolt, the bolt is inserted into a bore hole by use of a bolting machine having a boom. The boom engages the cable bolt head and drives the cable bolt up into the bore hole. The blind end of the bore hole typically contains a resin capsule which ruptures when the cable bolt is forced into the blind end of the bore hole. The boom spins the cable bolt to mix the resin. The resin adheres between the rock and the cable bolt and sets within a matter of minutes. The boom of the rock bolting machine then is removed from the cable bolt head.

This procedure provides a certain tension within the cable bolt to compress the rock strata. However, it is desirable to induce additional tension into the system beyond the tension exerted by the installation process. Tension is exerted on conventional rock bolts by compressing the bolt head of the rock bolt against the bearing plate which presses against the mine roof surface.

A mine roof bearing plate which exerts tension in a rock bolt system is disclosed in U.S. Pat. No. 3,478,523. The mine roof bolt bearing plate includes a central conical frustum provided with an opening. A spherical seat in the opening accommodates a spherical surface of a bolt head. When the bolt is installed, the bolt transmits a compressive force in an angular and radial direction from the spherical seat. The tension is transmitted practically in its entirety to the peripheral flange of the roof plate which becomes flattened against the roof. No deflection takes place in the area of the conical frustum.

U.S. Pat. No. 4,112,693 discloses a planar mine roof support plate having a ribbed dome section extending outwardly from the planar section. The roof plate deflects a maximum of 0.120 inches when between 6,000 to 15,000 pounds are loaded on the plate. U.S. Pat. No. 4,445,808 discloses a pyramidal dome roof plate which transmits compressive loads to the peripheral edges of the roof plate.

Although certain of these prior art patents disclose compressive mine roof bearing plates, none are resilient so that they exert tension on a mine roof bolt or a cable mine roof bolt. Accordingly, a need remains for a mine roof bearing plate and a mine roof bearing plate assembly which provides tension to a cable bolt.

SUMMARY OF THE INVENTION

The present invention includes a mine roof bearing plate having a planar member with a topside, an underside and an elastically deformable dome portion extending downwardly from the underside. A central portion at the outer extremity of the dome portion defines a bolt hole. The outer extremity of the dome portion includes a downwardly facing beveled annular bearing surface which defines the bolt hole. The dome portion is preferably frustoconical in configuration and extends downwardly from the planar member at an angle of about 30 to 40 degrees.

The present invention also includes a mine roof bearing assembly having the above described mine roof bearing plate and a washer having a concave upper surface, preferably a spherical washer, seated in the bolt hole. The concave upper surface mates with the beveled annular surface of the mine roof bearing plate.

The present invention further includes a method of manufacturing the inventive mine roof bearing plate having the steps of 1) providing a planar slab of steel, and 2) punching a bore hole in a central portion of the slab to form a cylindrical bearing surface. A hanger may be produced in the mine roof bearing plate by 1) slicing a slit in an edge of the slab extending between two opposing edges of the slab, and 2) pressing a hanger portion downwardly from the edge having said slit.

The present invention also includes a method of tensioning a cable bolt comprising the steps of placing a spherical washer over a first end of a cable bolt, the cable bolt having a bolt head on the other end, placing a mine roof bearing plate over the first end of the cable bolt. The mine roof bearing plate includes a planar member having a topside, an underside and an elastically deformable domed portion extending downwardly from the underside. The outer extremity of the domed portion includes an annular surface cooperating with the spherical washer. The cable bolt is inserted into a mine roof bore hole and pressure is exerted on the bolt head of the cable bolt, such that the bolt head presses on the lower surface spherical washer. Pressure on the spherical washer causes the domed portion to elastically deform. The cable bolt is installed in the bore hole by conventional methods such as by resin grouting or with a mechanical anchor. The pressure on the bolt head is released and the domed head is allowed to substantially reform to its original position thereby increasing the total tension effected by the bolt. Preferably, the domed portion deforms about 0.100 to 0.125 inch.

DESCRIPTION OF THE PREFERRED EMBODIMENTS

Figure 1:
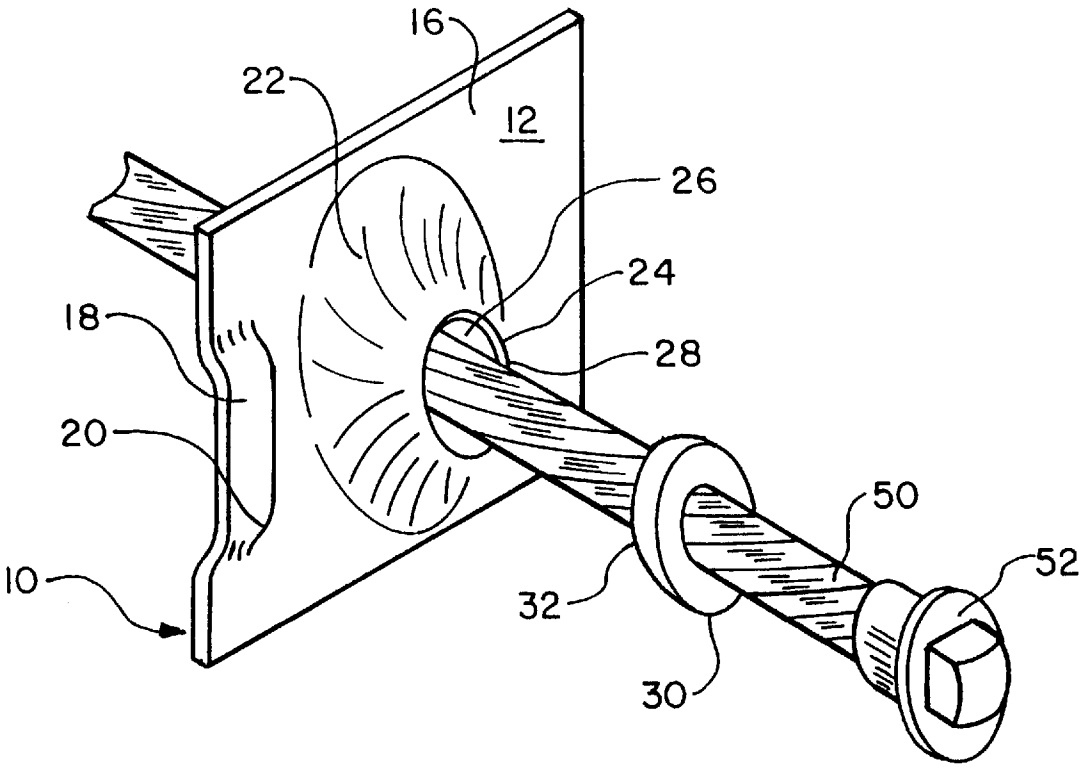
FIG. 1 is a perspective exploded view of the mine roof bearing assembly of the present invention with a cable bolt.
Figure 2:
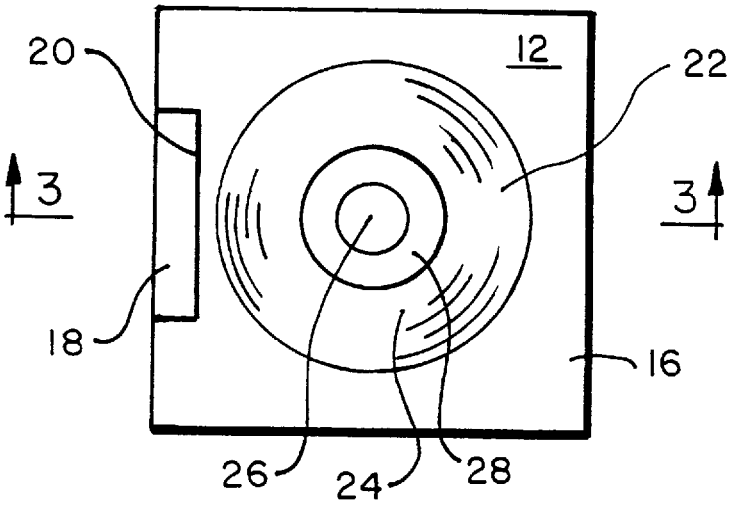
FIG. 2 is a bottom view of the mine roof bearing assembly of the present invention.

The cable tensioning dome plate of the present invention is illustrated in FIGS. 1–4. The dome plate 10 is manufactured from steel such as A36 or A50 cold rolled steel or hot rolled steel. The dome plate 10 includes a planar member 12 having a topside 14 and underside 16. One edge of the planar member 12 includes a hanger 18 formed by a slot 20 at the periphery of the planar member 12. The hanger 18 provides a structure for the hanging of wires, lights, tubing and the like. The hanger 18 extends downwardly in the direction of the underside 16 of the planar member 12.

Figure 3:
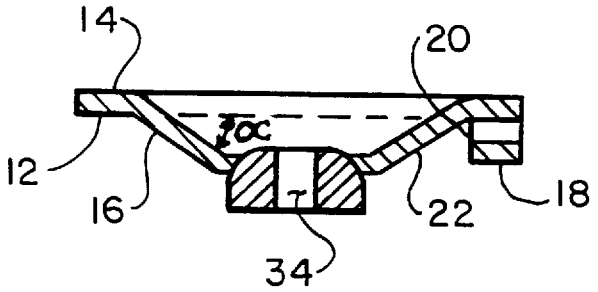
FIG. 3 is a sectional view of the mine roof bearing plate with spherical washer taken through line 3—3 of FIG. 2.
Figure 4:
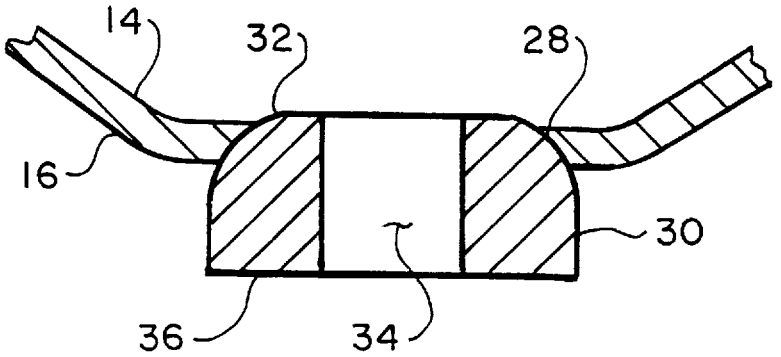
FIG. 4 is an enlarged view of a portion of FIG. 3.

The planar member 12 includes an elastically deformable domed portion 22 extending downwardly from the underside 16. The domed portion is preferably frustoconical in configuration. The angle formed between the frustoconical domed portion 22 and the planar member, shown as $\alpha$ in FIG. 3, is preferably 30 to 40 degrees. The precise angle of $\alpha$, the thickness of the bearing plate, the material of the bearing plate and the metallurgical processing such as a heat treatment can be adjusted to control the strength and resiliency of the domed portion. A central portion 24 in the domed portion 22 formed at the outer extremity of the dome portion defines a bolt hole 26 and includes an annular bearing surface 28. The annular bearing surface 28 is preferably beveled or chamfered and faces downwardly in the direction of the underside 16.

The mine roof bearing plate 10 preferably is manufactured in a hydraulic press. Typically, 8 inch by 8 inch slabs of ¼ inch thick steel are cut. The bolt hole 26 preferably is punched out from the center of the slab to form a bearing surface. The domed portion 22 preferably is formed by pressing the top side 14 of the slab with a die. During formation of the domed portion 22, the annular bearing surface 28 is forced downward and outward which causes the annular bearing surface to turn outwards and results in the beveled or chamfered characteristic of the annular bearing surface 28. The resulting mine roof bearing plate meets ANSI/ASTM Specification F432-88.

A hanger preferably is produced in the mine roof bearing plate by 1) slicing a slit in an edge of the slab which extends between two opposing edges of the slab and 2) pressing a hanger portion downwardly in the direction of the domed portion in the slit edge of the slab.

The present invention further includes a mine roof bearing assembly having the above-described mine roof bearing plate 10 and a spherical washer 30 seated in the bolt hole 26 of the domed portion 22. The spherical washer 30 includes an upper concave surface 32 which cooperates with the beveled annular bearing surface 28 of the domed portion 22. A central bolt hole 34 passes through the washer 30. The underside of the washer 30 includes a substantially planar surface 36. A mine roof bolt head can be disposed against the planar surface 36 of the spherical washer 30.

The present invention further includes a method of exerting tension in an installed cable bolt. As depicted in FIG. 1, the spherical washer is placed over a first end of a cable bolt 50 having a conventional bolt head 52 on the opposite end. The bolt head 52 is configured to engage with a boom of a bolting machine. The above-described mine roof bearing plate 10 is slipped over the first end of the cable bolt 50. The beveled annular bearing surface 28 of the elastically deformable domed portion 22 cooperates with the concave surface 32 of the spherical washer 30. The cable bolt bearing the spherical washer and mine roof bearing plate is inserted into a predrilled mine roof bore hole by use of a bolting machine. A boom of the bolting machine spins the cable bolt into the borehole and exerts pressure on the mine roof bolt head. The bolt head presses on the planar surface 36 of the spherical washer 30. The pressure exerted on the spherical washer 30 is transmitted to the domed portion 22 of the bearing plate 10. Sufficient boom pressure exerted on the spherical washer 30 to deform the domed portion 22 currently is believed to be about 10,000 pounds. Under normal loading conditions, the domed portion then deforms about 0.100 to 0.125 inches upwards towards the mine roof. The cable bolt is installed in the bolt hole by use of resin grouting or a mechanical anchor or the like.

Once the resin sets or mechanical anchor fixes into the borehole and the bolt is installed, the boom is removed from the bolt head of the cable bolt. Upon release of pressure from the boom of the bolting machine, the elastically deformable domed portion 22 substantially reforms to its original configuration. As the domed portion 22 substantially elastically reforms to its original configuration, it exerts tension on the cable bolt by acting as a spring between the mine roof and washer.

Cable bolts typically are subjected to lateral stresses caused by shifts in the rock strata. Cable bolts, contrary to conventional rock bolts, are flexible and can withstand a degree of lateral stress. The beveled annular bearing surface 28 of the domed portion 22 of the inventive mine roof bearing plate allows a spherical or concave washer to swivel within the bolt hole 26. This swivel action permits further lateral mobility of the cable bolt than would be possible with a standard washer seated in a cylindrical or other conventional surface of a bearing plate.

All of the present invention has been described in detail in connection to the discussed embodiments, various modifications may be made by one of ordinary skill in the art without departing from the spirit and scope of the present invention. Therefore, the scope of the present invention should be determined by the attached claims.

What is claimed is:

1. A mine roof bearing plate comprising:

a planar member having a topside, an underside, a peripheral flange and a domed portion extending downwardly from said underside; and a central section at the outer extremity of said domed portion defining a bolt hole, wherein said domed portion deforms under an installation load and reforms to substantially an original configuration of said domed portion upon release of the installation load.

2. The mine roof bearing plate of claim 1 wherein said outer extremity of said domed portion comprises a downwardly facing beveled annular bearing surface, said bearing surface defining said bolt hole.

3. The mine roof bearing plate of claim 1 wherein said domed portion is of frustoconical configuration.

4. The mine roof bearing plate of claim 3 wherein said domed portion extends downwardly from said planar member at an angle of about 30 to 40 degrees.

5. A mine roof bearing assembly comprising:

a planar member having a topside, an underside, a peripheral flange and a domed portion extending downwardly from said underside;

a central section at the outer extremity of said domed portion defining a bolt hole; and a washer seated in said bolt hole, wherein said domed portion deforms under an installation load and reforms to substantially an original configuration of said domed portion upon release of the installation load.

6. The mine roof bearing assembly of claim 5 wherein said outer extremity of said domed portion comprises a downwardly facing beveled annular bearing surface, said bearing surface defining said bolt hole.

7. The mine roof bearing assembly of claim 6 wherein said washer comprises a concave upper surface.

8. The mine roof bearing assembly of claim 5 wherein said domed portion is of frustoconical configuration.

9. The mine roof bearing assembly of claim 8 wherein said domed portion extends downwardly from said planar member at an angle of about 30 to 40 degrees.

10. A method of tensioning a cable bolt comprising the steps of:

1) placing a spherical washer over a first end of a cable bolt having a bolt head on the other end;

2) placing a mine roof bearing plate over said first end of said cable bolt, said mine roof bearing plate comprising a planar member having a topside, an underside and an elastically deformable domed portion extending downwardly from said underside, the outer extremity of said domed portion comprising an annular surface cooperating with said spherical washer;

3) inserting said cable bolt into a mine roof bolt hole;

4) exerting pressure on said bolt head whereby said bolt head presses on said spherical washer and said spherical washer presses against said domed portion and elastically deforms said domed portion;

5) installing said cable bolt in said bolt hole; and 6) releasing pressure from said bolt head wherein said domed portion substantially reforms.

11. The method of claim 10 wherein said annular surface is beveled.

12. The method of claim 10 wherein said domed portion deforms about 0.100 to 0.125 inch when said bolt head exerts about 10,000 pounds on said domed portion.

* * * * *